US011214081B2

(12) United States Patent
Miura

(10) Patent No.: US 11,214,081 B2
(45) Date of Patent: Jan. 4, 2022

(54) PRINTING APPARATUS

(71) Applicant: BROTHER KOGYO KABUSHIKI KAISHA, Nagoya (JP)

(72) Inventor: Katsuro Miura, Toyota (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/088,095

(22) Filed: Nov. 3, 2020

(65) Prior Publication Data

US 2021/0178785 A1 Jun. 17, 2021

(30) Foreign Application Priority Data

Dec. 17, 2019 (JP) ..... JP2019-227560

(51) Int. Cl.
*B41J 11/66* (2006.01)
*B41J 11/00* (2006.01)

(52) U.S. Cl.
CPC ..... *B41J 11/663* (2013.01); *B41J 11/003* (2013.01)

(58) Field of Classification Search
CPC ..... B41J 11/003; B41J 11/007; B41J 11/663; B41J 11/70; B41J 11/0095; B41J 13/0009; B41J 13/0054
See application file for complete search history.

(56) References Cited

U.S. PATENT DOCUMENTS

2011/0211006 A1* 9/2011 Ochiai ..... B41J 15/00 347/16

FOREIGN PATENT DOCUMENTS

| | | | | |
|---|---|---|---|---|
| JP | 11-84777 A | | 3/1999 | |
| JP | 2005-169934 A | | 6/2005 | |
| JP | 2011-121777 | | 6/2011 | |
| JP | 2013212925 A | * | 10/2013 | ..... G03G 15/6561 |
| JP | 2018-186448 A | | 11/2018 | |

OTHER PUBLICATIONS

Nagura, MachineTranslationofJP-2013212925-A (Year: 2013).*

* cited by examiner

*Primary Examiner* — Scott A Richmond
(74) *Attorney, Agent, or Firm* — Merchant & Gould P.C.

(57) ABSTRACT

A print engine performs printing on a print medium conveyed by a conveyor. The cutter cuts the print medium conveyed by the conveyor. The first sensor is provided upstream of the cutter in the conveyance direction and detects a leading end and a trailing end of the print medium. The second sensor detects a conveyance amount of the print medium conveyed by the conveyor. The controller determines a print medium length that is a length of the print medium in the conveyance direction, based on the conveyance amount detected by the second sensor from when the first sensor detects the leading end of the print medium until when the first sensor detects the trailing end of the print medium, determines a cutting position of the print medium based on the determined print medium length, and controls the cutter to cut the print medium at the determined cutting positon.

13 Claims, 11 Drawing Sheets

(TEST CUTTING OPERATION)

(TEST READING OPERATION)

PRINTING APPARATUS

CROSS REFERENCE TO RELATED APPLICATIONS

This application claims priority from Japanese Patent Application No. 2019-227560 filed Dec. 17, 2019. The entire content of the priority application is incorporated herein by reference.

TECHNICAL FIELD

This disclosure relates to a printing apparatus having a cutting function for a print medium.

BACKGROUND

Conventionally, some printing apparatuses such as an image forming apparatus that use standard-sized paper have a function of cutting paper into two parts, for example. For example, there is disclosed an image forming apparatus that, when there is not enough first paper, cuts second paper having a size twice as large as that of the first paper and uses the obtained paper as the first paper.

SUMMARY

According to one aspect, this specification discloses a printing apparatus. The printing apparatus includes a tray, a conveyor, a print engine, a cutter, a first sensor, a second sensor, and a controller. The tray is configured to accommodate a print medium. The conveyor is configured to feed the print medium from the tray and to convey the print medium along a conveyance direction. The print engine is configured to perform printing on the print medium conveyed by the conveyor. The cutter is configured to cut the print medium conveyed by the conveyor. The first sensor is provided upstream of the cutter in the conveyance direction and is configured to detect a leading end and a trailing end of the print medium. The second sensor is configured to detect a conveyance amount of the print medium conveyed by the conveyor. The controller is configured to: determine a print medium length that is a length of the print medium in the conveyance direction, based on the conveyance amount detected by the second sensor from when the first sensor detects the leading end of the print medium until when the first sensor detects the trailing end of the print medium; determine a cutting position of the print medium based on the determined print medium length; and control the cutter to cut the print medium at the determined cutting positon.

BRIEF DESCRIPTION OF THE DRAWINGS

Embodiments in accordance with this disclosure will be described in detail with reference to the following figures wherein.

DETAILED DESCRIPTION

Even in a case of a standard size paper, the size actually varies slightly from paper to paper. For example, in A4 size paper, a tolerance of ±2 mm is allowed for the standard length 297 mm of the long side, and a size difference of up to 4 mm can occur between the papers.

In particular, the paper length varies greatly from lot to lot, and a paper tray does not always contain the same lot of paper.

Thus, if the cutting position is determined based on the standard size, there is a problem that the paper size after cutting varies due to the size variation of the original paper.

In view of the foregoing, an aspect of an objective of this disclosure is to provide a printing apparatus configured to cut print paper to a particular size accurately.

First Embodiment

A first embodiment of this disclosure will be described in detail.

The printing apparatus may be a multifunction peripheral having a plurality of functions such as a scanning function, a printing function, a copying function, and a fax function. In the following description, an upper-lower direction, a left-right direction, and a front-rear direction of a printer 1 are defined with reference to the state of FIG. 1 in which the printer 1 is installed such that that the printer 1 is usable.

[Outline of Printer 1]

Figure 1:
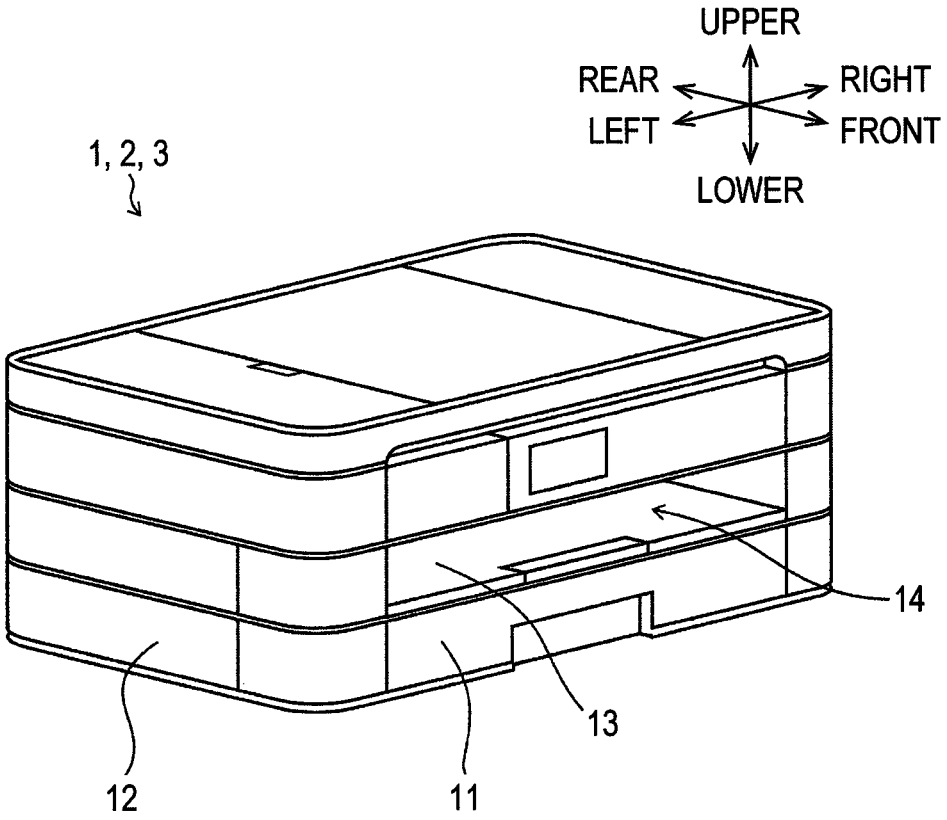
FIG. 1 is a perspective view showing a printer as an example of a printing apparatus according to an embodiment of this disclosure.

As shown in FIG. 1, the printer 1 has a substantially rectangular-parallelepiped shape and has a function of printing an image on both sides of print paper as an example of a print medium by an inkjet method. The printer 1 may record an image on print paper by an electrophotographic method, for example, instead of the inkjet method.

As shown in FIG. 1, the printer 1 includes a paper feed tray 11 as an example of an accommodating portion at a lower part thereof, and also includes a housing 12 for accommodating the components of the printer 1 inside. A paper discharge tray 13 is provided above the paper feed tray 11, and an opening 14 is formed above the paper discharge tray 13.

[Structure Inside Printer 1]

Figure 2A:
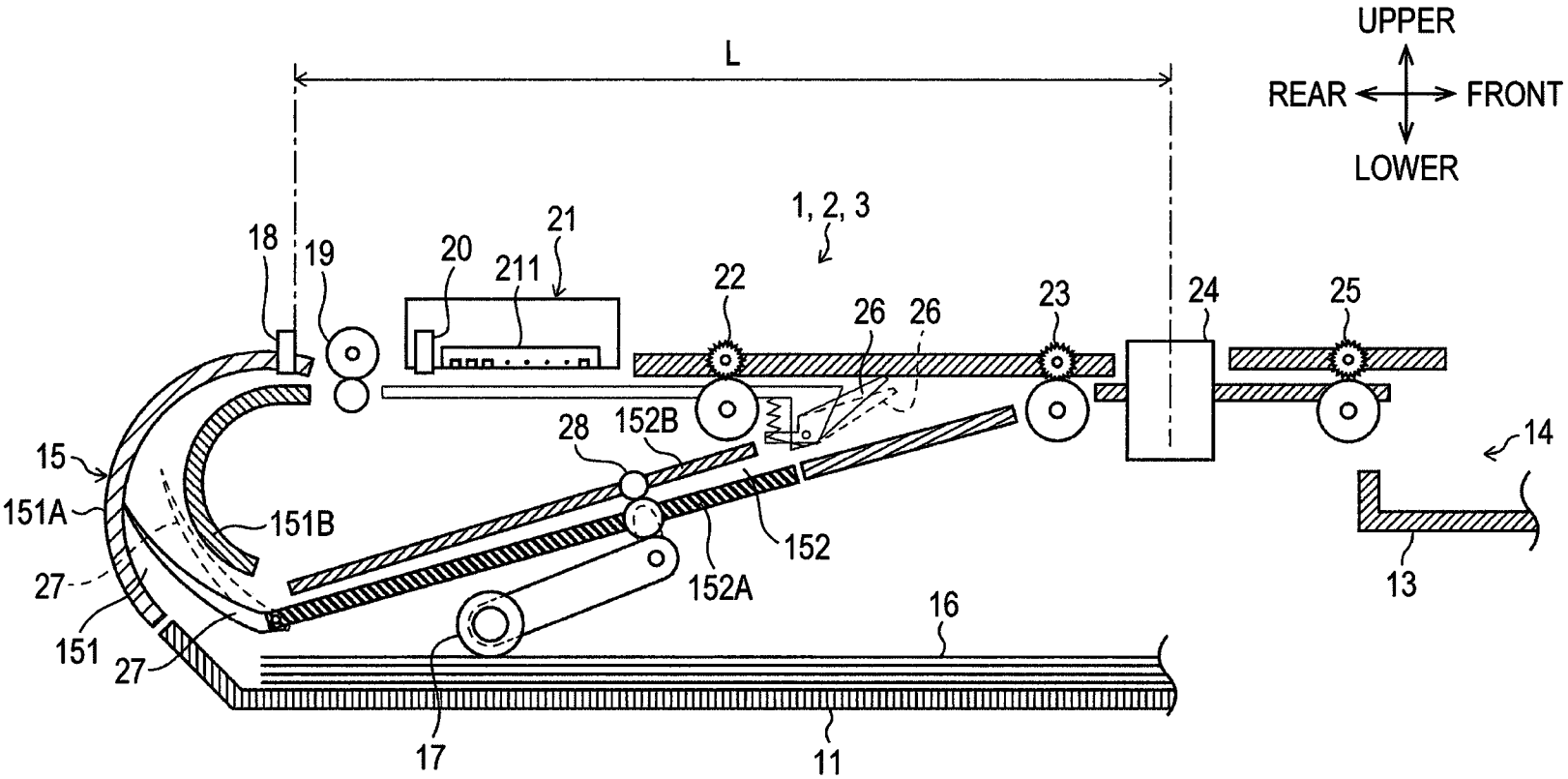
FIG. 2A is a schematic vertical cross-sectional view showing the internal structure of the printer shown in FIG. 1.

As shown in FIG. 2A, the printer 1 includes the paper feed tray 11, the paper discharge tray 13, and a conveyance unit 15 inside the housing 12. The conveyance unit 15 has a main conveyance path 151 formed from the paper feed tray 11 to the paper discharge tray 13 and a reverse conveyance path 152 that branches off from the main conveyance path 151. The reverse conveyance path 152 is formed by members 152A and 152B.

The paper feed tray 11 accommodates print paper 16. The conveyance unit 15 conveys the print paper 16 fed from the paper feed tray 11 to a terminal position of the main conveyance path 151 through the main conveyance path 151, and discharges the print paper 16 from the main conveyance path 151 onto the paper discharge tray 13. Further, the conveyance unit 15 reverses the print paper 16 conveyed by the main conveyance path 151 by using the reverse conveyance path 152 and then returns the print paper 16 to the main conveyance path 151, and similarly discharges the print paper 16 from the main conveyance path 151 onto the paper discharge tray 13. The conveyance unit 15 takes the print paper 16 on the paper feed tray 11 into the main conveyance path 151 by using a feed roller 17 provided on the paper feed tray 11. The main conveyance path 151 is curved in a semicircular arc shape toward the forward direction from the vicinity of a start portion on the paper feed tray 11 side. The curved portion of the main conveyance path 151 is formed by members 151A and 151B.

On the main conveyance path 151 between the paper feed tray 11 and the paper discharge tray 13, from the upstream side in the conveyance direction of the print paper 16 (hereinafter, simply referred to as the upstream side) toward the downstream side in the conveyance direction (hereinafter, simply referred to as the downstream side), a trailing end sensor 18, a pair of first conveyance rollers 19, a leading end sensor 20, a print engine 21, a pair of second conveyance rollers 22, a pair of third conveyance rollers 23, a cutter 24, and a pair of fourth conveyance rollers 25 are provided. The trailing end sensor 18 and the leading end sensor 20 together constitute an example of a first sensor. Hereinafter, the pair of conveyance rollers is simply referred to as conveyance rollers.

The first conveyance rollers 19 are located immediately upstream of the print engine 21. The second conveyance rollers 22 are located between the print engine 21 and the upstream end of the reverse conveyance path 152. The third conveyance rollers 23 are located between the upstream end of the reverse conveyance path 152 and the cutter 24. The fourth conveyance rollers 25 are located between the cutter 24 and the downstream end of the main conveyance path 151. The fourth conveyance rollers 25 function as a discharge roller for discharging the print paper 16 onto the paper discharge tray 13.

The trailing end sensor 18 detects the trailing end of the print paper 16 conveyed along the main conveyance path 151. The leading end sensor 20 detects the leading end of the print paper 16 conveyed along the main conveyance path 151. The print engine 21 includes an inkjet recording head 211, and prints an image on the print paper 16 by using the recording head 211. The cutter 24 cuts the print paper 16 with a cutting blade so as to divide the print paper 16 into upstream and downstream portions in the conveyance direction.

The reverse conveyance path 152 has an upstream end located at the upstream side of the third conveyance rollers 23 and a downstream end located near the start portion of the main conveyance path 151. A first flap 26 is provided at the upstream end of the reverse conveyance path 152, and a second flap 27 is provided at the downstream end of the reverse conveyance path 152. The first flap 26 and the second flap 27 operate so as to switch the conveyance direction of the print paper 16. A pair of fifth conveyance rollers 28 is provided on the reverse conveyance path 152. The first to fifth conveyance rollers 19, 22, 23, 25, and 28 nip and convey the print paper 16.

[Configuration of Control Device]

Figure 3:
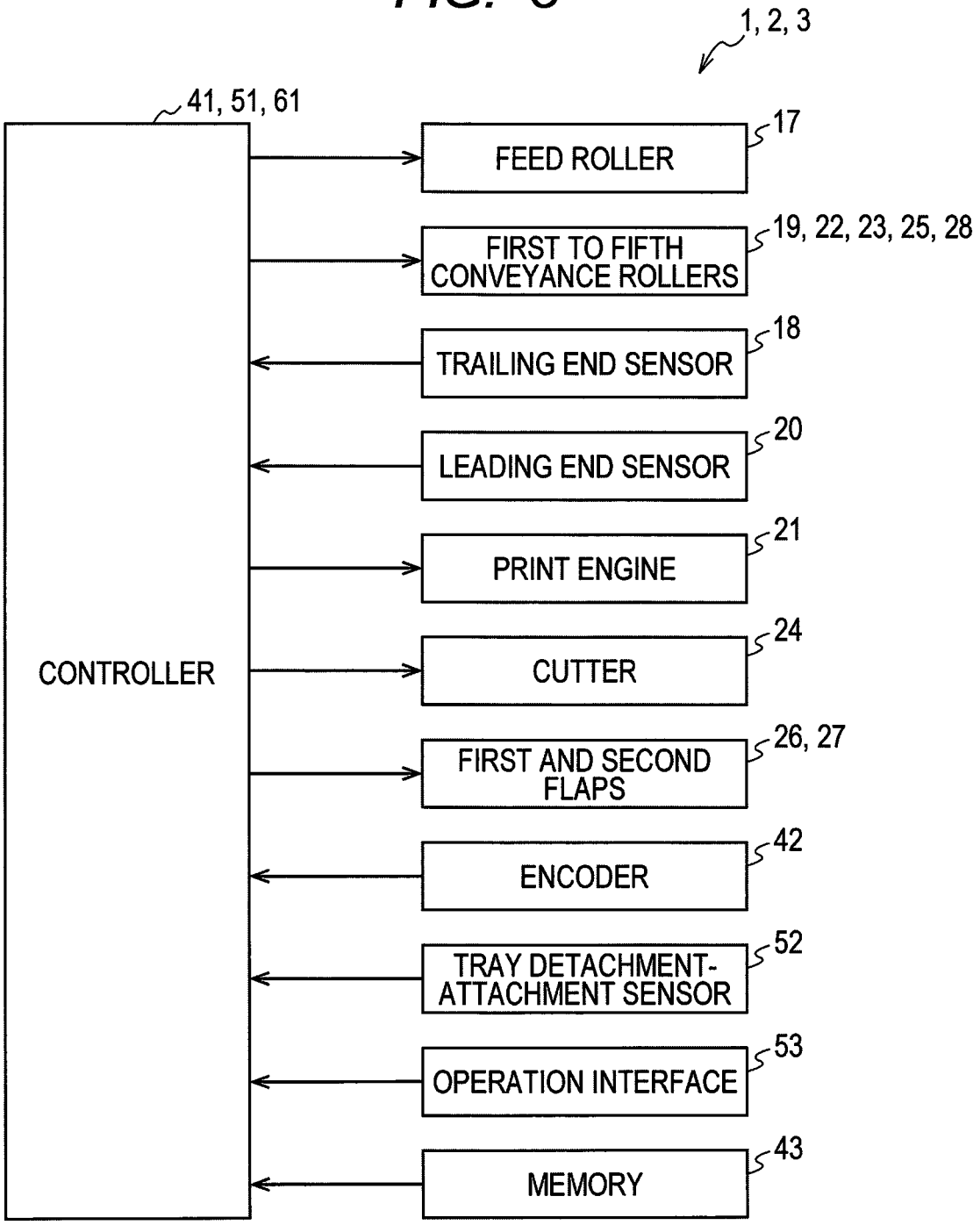
FIG. 3 is a block diagram showing the configuration of a control device included in the printer shown in FIG. 1.

As shown in FIG. 3, the control device includes a controller 41 which is a microcomputer. The controller 41 is connected to the feed roller 17, the first to fifth pairs of conveying rollers 19, 22, 23, 25, and 28, the trailing end sensor 18, the leading end sensor 20, the print engine 21, the cutter 24, the first and second flaps 26 and 27, an encoder 42 as an example of a second sensor, and a memory 43. The controller 41 controls the operations of the conveyance unit 15 (that is, the feed roller 17 and the first to fifth pairs of conveyance rollers 19, 22, 23, 25, and 28), the print engine 21, the cutter 24, and the first and second flaps 26, 27. The control targets controlled by the controller 41 for driving the feed roller 17, the first to fifth pairs of conveyance rollers 19, 22, 23, 25, 28, and the first and second flaps 26, 27 are drive units such as one or more motor that drives these components.

The first and second flaps 26 and 27 are moved between a reverse guide position (the solid line position in FIG. 2A) and a retracted position (the broken line position in FIG. 2A) by the control of the controller 41. The reverse guide position is a position where the first flap 26 guides the print paper 16 conveyed in the reverse direction by reverse rotation of the third conveyance rollers 23 from the main conveyance path 151 to the reverse conveyance path 152, and the second flap 27 guides the print paper 16 from the reverse conveyance path 152 to the main conveyance path 151. The retracted position is a position where the first flap 26 and the second flap 27 do not block conveyance of the print paper 16 from the paper feed tray 11 to the paper discharge tray 13 on the main conveyance path 151.

The encoder 42 is a rotary encoder, for example. The encoder 42 is provided at the rotation shaft of the first conveyance roller 19, and detects the conveyance amount of the print paper 16 which is the amount of conveyance due to the rotation of the first conveyance roller 19. The encoder 42 is provided not only at the first conveyance roller 19 but also at the conveyance rollers 22, 23, and 25 appropriately in order to detect the position of the print paper 16 on the conveyance path 151. The memory 43 stores various information associated with the operations of the controller 41.

[Distance Between Trailing End Sensor 18 and Cutter 24]

In the printer 1, a relationship $L>A-a$ is satisfied, assuming that "L" is the distance between the trailing end sensor 18 and the cutter 24 in the conveyance direction of the print paper 16, that "A" is a print paper length which is the length of particular print paper in the conveyance direction, the particular print paper being a particular print medium which is one of a plurality of standard sizes of the print paper 16, and that "a" is the length from the leading end of the particular print paper to the cutting position.

Figure 2B:
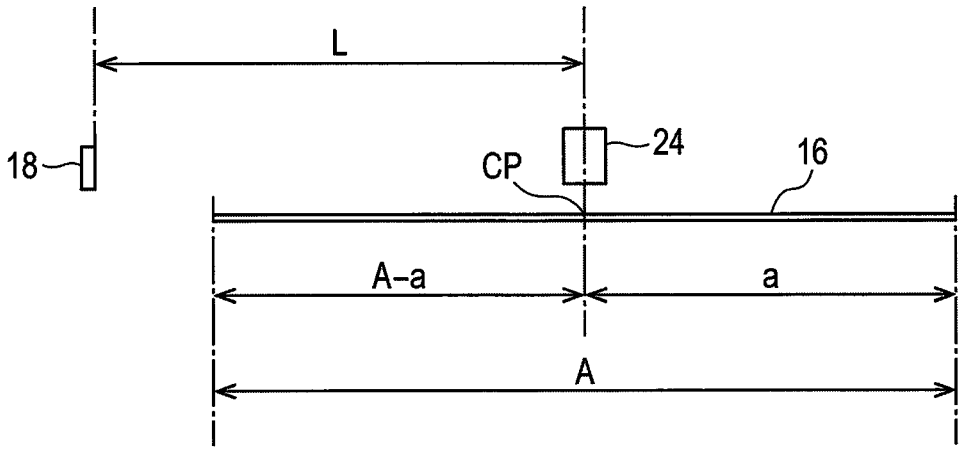
FIG. 2B is an explanatory diagram showing a relationship among "L" which is the distance between a trailing end sensor and a cutter in a conveyance direction, "A" which is the length of particular print paper in the conveyance direction, and "a" which is the length from a leading end of the particular print paper to a cutting position on the particular print paper to be cut by a cutter.

For example, when the particular print paper is the A4 size, the print paper length A is 299 mm which is obtained by adding the maximum tolerance of 2 mm to the standard print paper length of 297 mm. When the A4 size print paper 16 is cut in half (see FIG. 2B), the length "a" from the leading end of the A4 size print paper 16 to a cutting position CP is 149.5 mm, which is half of 299 mm. Thus, the distance L between the trailing end sensor 18 and the cutter 24 is longer than 149.5 mm (L>149.5 mm). With this configuration, at the time when the trailing end of the print paper 16 passes the trailing end sensor 18 and the print paper length A is obtained, the half position (the cutting position CP) of the print paper has not reached the cutter 24 yet. Thus, the print paper is further conveyed (without conveying the print paper reversely), and the print paper is cut when the half position (the cutting position CP) of the print paper reaches the cutter 24.

[Operation of Printer 1]

In the above configuration, the operation of the printer 1 will be described below.

Figure 4:
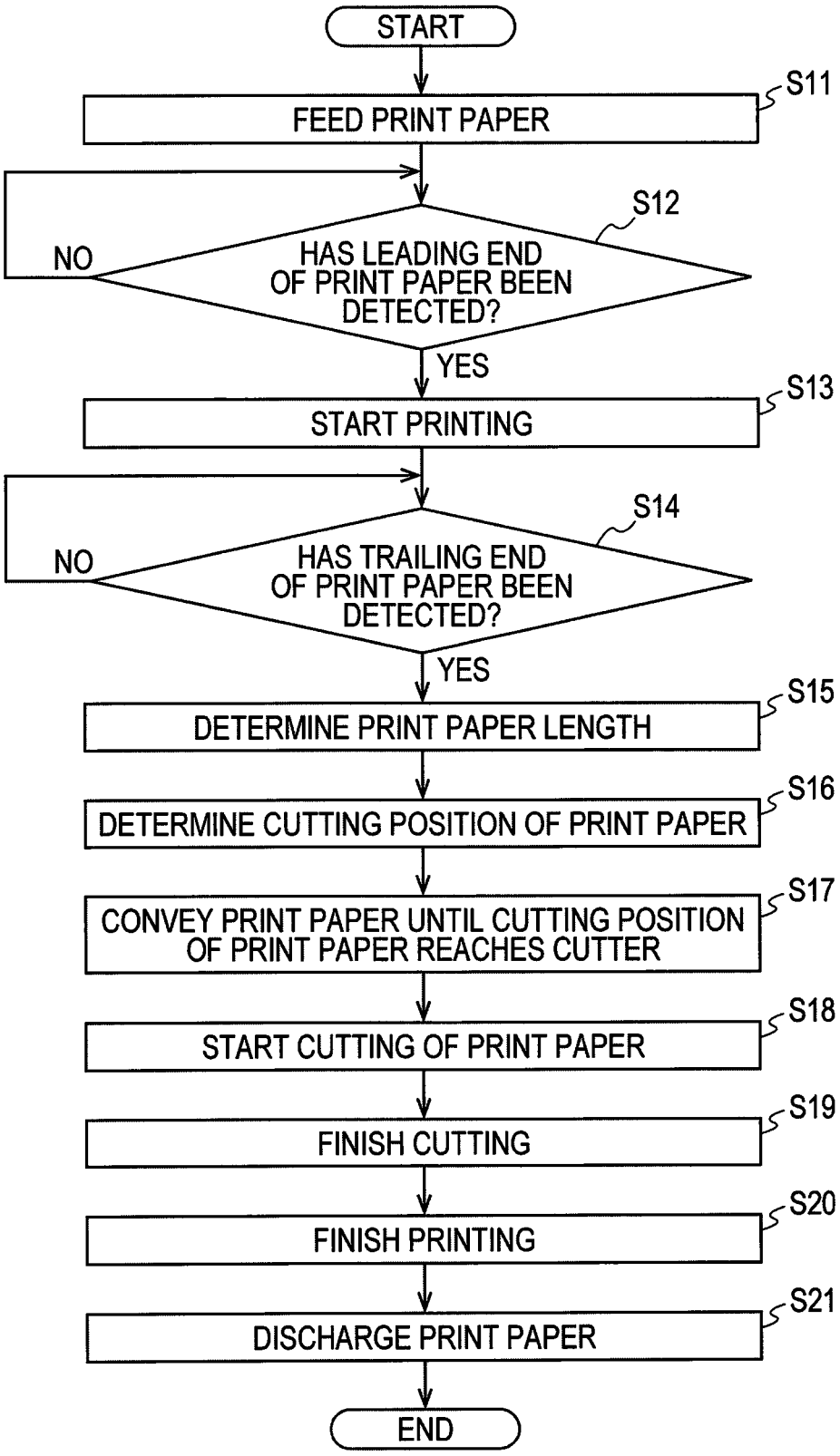
FIG. 4 is a flowchart showing the operation of the printer when printing and cutting of print paper are performed based on the control of a controller shown in FIG. 3.

FIG. 4 shows the operation of the printer 1 when printing and cutting of the print paper 16 are performed by the control of the controller 41. Here, a case where the print paper 16 is cut in half will be described as an example.

When printing and cutting are performed for the print paper 16 on the paper feed tray 11, the feed roller 17 rotates to send the print paper 16 to the main conveyance path 151 (S11). Then, the conveyance unit 15 conveys the print paper 16 through the main conveyance path 151. In this case, the first flap 26 and the second flap 27 of the reverse conveyance path 152 are located at the retracted positions.

Next, when the leading end sensor 20 detects the leading end of the print paper 16 (S12), the print engine 21 starts printing on the print paper 16 (S13).

In this case, the controller 41 controls the conveyance unit 15 and the print engine 21 such that a line feed operation and a recording operation are alternately repeated to perform printing on the print paper 16. The line feed operation is an operation of conveying the print paper 16 by the amount of line feed determined based on the acquired print data. The recording operation is an operation in which the print engine 21 records an image for one line while the conveyance of the print paper 16 is stopped.

Next, when the trailing end sensor 18 detects the trailing end of the print paper 16 (S14), the controller 41 determines the print paper length which is the length of the print paper 16 in the conveyance direction of (S15). In this case, the controller 41 calculates the print paper length based on the conveyance amount of the print paper 16 detected by the encoder 42 from when the leading end sensor 20 detects the leading end of the print paper 16 until when the trailing end sensor 18 detects the trailing end of the print paper 16 (print-medium-length determination operation).

More specifically, since the leading end sensor 20 is separated from and downstream of the trailing end sensor 18 in the example of FIG. 2A, the print paper length is obtained by the equation "the print paper length=the conveyance amount of the print paper 16+ the distance between the trailing end sensor 18 and the leading end sensor 20 in the conveyance direction".

Alternatively, the leading end and the trailing end may be detected by one sensor. For example, the leading end and the trailing end may be detected by the sensor 18, and the print paper length may be obtained from the conveyance amount of the print paper between detection of the leading end and detection of the trailing end. Further, the same operation can be performed by the sensor 20 as long as the relationship L>A−a is satisfied.

Next, the controller 41 determines the cutting position of the print paper 16 (S16). For example, in a case where it is preliminarily set by the user that the print paper 16 is to be cut in half, the cut position is the position of a half (½) of the print paper length from the trailing end of the print paper 16.

Next, the conveyance unit 15 conveys the print paper 16 until the cutting position of the print paper 16 reaches the cutter 24 (S17), and when the cutting position of the print paper 16 reaches the cutter 24, the cutter 24 starts cutting of the print paper 16 (S18). The controller 41 estimates the conveyance amount of the print paper 16 based on the rotation amount of each of the conveyance rollers 19, 22, 23, and 25 after the trailing end sensor 18 detects the trailing end of the print paper 16, and detects that the cutting position of the print paper 16 has reached the cutter 24 based on the estimated conveyance amount. The rotation amount of each of the conveyance rollers 22, 23, and 25 is detected by using an encoder in the same manner as the conveyance roller 19.

In this case, the controller 41 identifies the line feed operation in which the cutting position of the print paper 16 passes through the cutter 24 among the above-mentioned line feed operations, and controls the conveyance unit 15 such that, in the identified line feed operation, the line feed operation is executed with a conveyance amount that is smaller than the determined line feed amount. With this operation, in the configuration in which the conveyance operation of the print paper 16 by the conveyance unit 15 and the recording operation on the print paper 16 by the print engine 21 are alternately repeated, the print paper 16 is accurately conveyed such that the cutting position of the print paper 16 is located accurately at the cutter 24.

After that, when cutting of the print paper 16 by the cutter 24 is finished (S19) and printing on the print paper 16 by the print engine 21 is finished (S20), the conveyance unit 15 discharges the print paper 16, that is, the cut print paper onto the paper discharge tray 13 (S21).

[Other Advantages of Printer 1]

In printer 1, the print paper 16 is cut after actually obtaining the print paper length which is the length of the print paper 16 in the conveyance direction. Thus, the print paper 16 can be cut accurately at a desired position regardless of the variation in the print paper length of each print paper 16. For example, the print paper 16 can be cut accurately at the half (½) position in the conveyance direction.

Before the print paper 16 having a print paper length shorter than or equal to the print paper length of the particular print paper reaches the cutter 24, the controller 41 detects the print paper length and determines the cutting position. Thus, for the print paper 16 having a print paper length shorter than or equal to the print paper length of the particular print paper, the print paper 16 can be cut without loss of time. That is, if the print paper 16 needs to be conveyed reversely for cutting the print paper 16 at the cutting position, it takes additional time.

Because the cutter 24 is located downstream of the print engine 21, the cutting operation of the print paper 16 by the cutter 24 and the printing operation by the print engine 21 can be performed at the same time, which enables high speed processing.

In the printer 1, the second conveyance rollers 22 and the third conveyance rollers 23, which are pairs of rollers for nipping and conveying the print paper 16, are provided between the print engine 21 and the cutter 24. Thus, printing with the print engine 21 can be performed in a stable manner. Note that it is sufficient that at least one pair of rollers is provided, and only the second conveyance rollers 22 or the third conveyance rollers 23 may be provided.

In the printer 1, the fourth conveyance rollers 25, which is a pair of rollers for nipping and conveying the print paper 16, is provided at a position downstream of the cutter 24. Thus, by the second conveyance rollers 22 (or the third conveyance rollers 23) and the fourth conveyance rollers 25, the positional deviation of the print paper 16 at the cutter 24 and the print misalignment at the print engine 21 can be suppressed.

Second Embodiment

Another embodiment of this disclosure is described below. For convenience of description, the same reference numerals are added to the members having the same functions as the members described in the above embodiment, and the description thereof is not repeated.

[Configuration of Control Device]

The control device of a printer 2 includes a controller 51 (see FIG. 3) instead of the controller 41. In this embodiment, the controller 51 controls the operation of the printer 2 based on the detection result of a tray detachment-attachment sensor 52 (an example of a third sensor), in addition to the operation of the controller 41. The paper feed tray 11 can be detached and attached, and the tray detachment-attachment sensor 52 detects the detachment and attachment of the paper feed tray 11.

[Operation of Printer 2]

Figure 5:
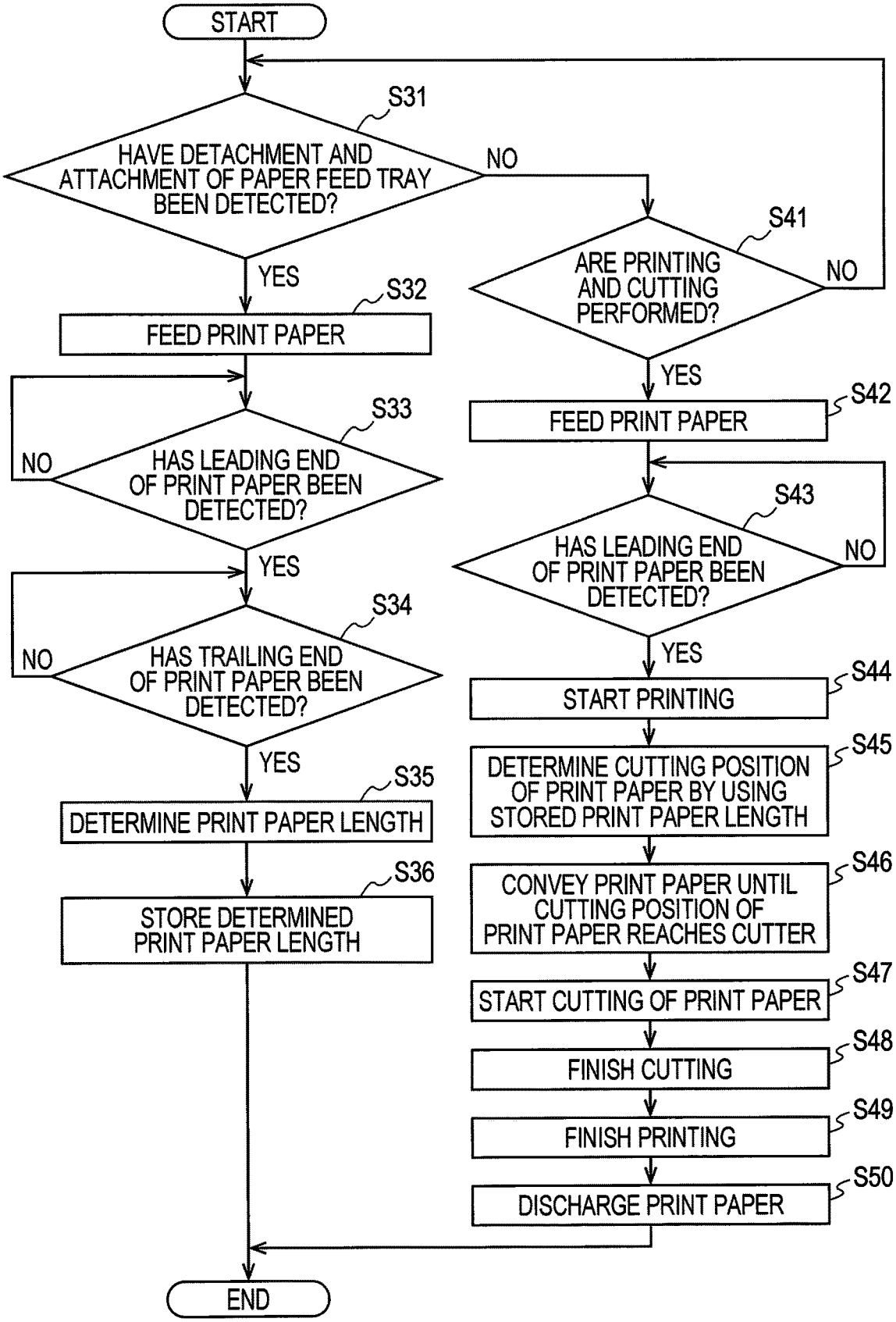
FIG. 5 is a flowchart showing the operation of a printer when a print paper length of print paper is determined and printing and cutting of print paper are performed based on the control of a controller included in the printer according to another embodiment of this disclosure.

FIG. 5 shows the operation of the printer 2 when the print paper length of print paper 16 is determined and printing and cutting of the print paper 16 are performed based on the control of the controller 51.

[Determination Operation of Print Paper Length]

As shown in FIG. 5, the controller 51 first determines whether the tray detachment-attachment sensor 52 has detected detachment and attachment of the paper feed tray 11 (S31). If the determination result in S31 is YES, the controller 51 performs no-printing/cutting conveyance of the print paper 16 and determines the print paper length (S32 to S35). The no-printing/cutting conveyance is an operation of conveying the print paper 16 through the main conveyance path 151 without printing or cutting the print paper 16.

Specifically, the controller 51 conveys the print paper 16 on the paper feed tray 11 through the main conveyance path 151 by the conveyance unit 15 (S32), detects the leading end of the print paper 16 (S33), detects the trailing end of the print paper 16 (S34), and determines the print paper length (print-medium-length determination operation) (S35). The determined print paper length is stored in the memory 43 (S36). The operations of S32 to S35 are the same as the operations of S11 and S14 to S16 shown in FIG. 4.

The print paper 16 used for determining the print paper length is discharged to the paper discharge tray 13. Alternatively, such print paper 16 is held in the reverse conveyance path 152 and used for the next job. When the print paper 16 is held in the reverse conveyance path 152, the controller 51 controls the first flap 26 and the second flap 27 to be located at the reverse guide positions (the solid line positions in FIG. 2A). Further, the controller 51 controls the third conveyance roller 23 to be rotated in the reverse direction and controls the fifth conveyance roller 28 to be rotated in the forward direction so as to take the print paper 16 into the reverse conveyance path 152, and then the fifth conveyance roller 28 is stopped.

[Printing and Cutting Operation]

When the determination result in S31 is NO and printing and cutting are performed on the print paper 16 (S41), the print paper 16 is fed to the main conveyance path 151 (S42), and the leading end of the print paper 16 is detected (S43), and printing on the print paper 16 is started (S44). Note that S42 and S43 are the same operations as S32 and S33.

Next, the controller 51 determines the cutting position of the print paper 16 by using the print paper length stored in the memory 43 (S45). Subsequent operations of S46 to S50 are the same as the operations of S17 to S21 in FIG. 4, and the description thereof is omitted.

[Advantages of Printer 2]

When the paper feed tray 11 is detached and attached by the user, it is assumed that the print paper 16 has been replenished. Within the same lot of replenished print paper 16, the print paper length of each print paper 16 is usually the same. Thus, in the printer 2, when the paper feed tray 11 is detached and attached, the first print paper 16 is conveyed for determining the print paper length (without printing or cutting), and the determined print paper length is stored in the memory 43. For the second and subsequent print paper 16, the cutting position of the print paper 16 is determined by using the print paper length stored in the memory 43. With this operation, the number of operations for determining the print paper length of the print paper 16 can be reduced, and the efficiency of the processing performed by the controller 51 can be improved.

Further, when the printed paper 16 conveyed for determining the print paper length is held in the reverse conveyance path 152 without being discharged to the paper discharge tray 13, the print paper 16 is returned from the reverse conveyance path 152 to the main conveyance path 151 and the print paper 16 can be reused for the next job. Other advantages of the printer 2 are similar to those of the printer 1.

Third Embodiment

Still another embodiment of this disclosure is described below. For convenience of description, the same reference numerals are added to the members having the same functions as the members described in the above embodiment, and the description thereof is not repeated.

[Configuration of Printer 3]

A printer 3 of this embodiment (see FIGS. 1 to 3) includes a plurality of paper feed trays 11 (an example of accommodating portions) for respective ones of a plurality of sizes of print paper 16 or for respective ones of a plurality of types of print paper 16. The plurality of paper feed trays 11 can be switched by the user's operation to an operation interface 53.

[Configuration of Control Device]

The control device of the printer 3 includes a controller 61 (see FIG. 3) instead of the controller 41. In addition to the operations of the controller 41 and the controller 51, in this embodiment, the controller 61 controls the operation of the printer 3 based on an input operation to the operation interface 53 for switching the paper feed tray 11. The operation interface 53 is an input interface to which the user performs an input operation.

[Operation of Printer 3]

Figure 6:
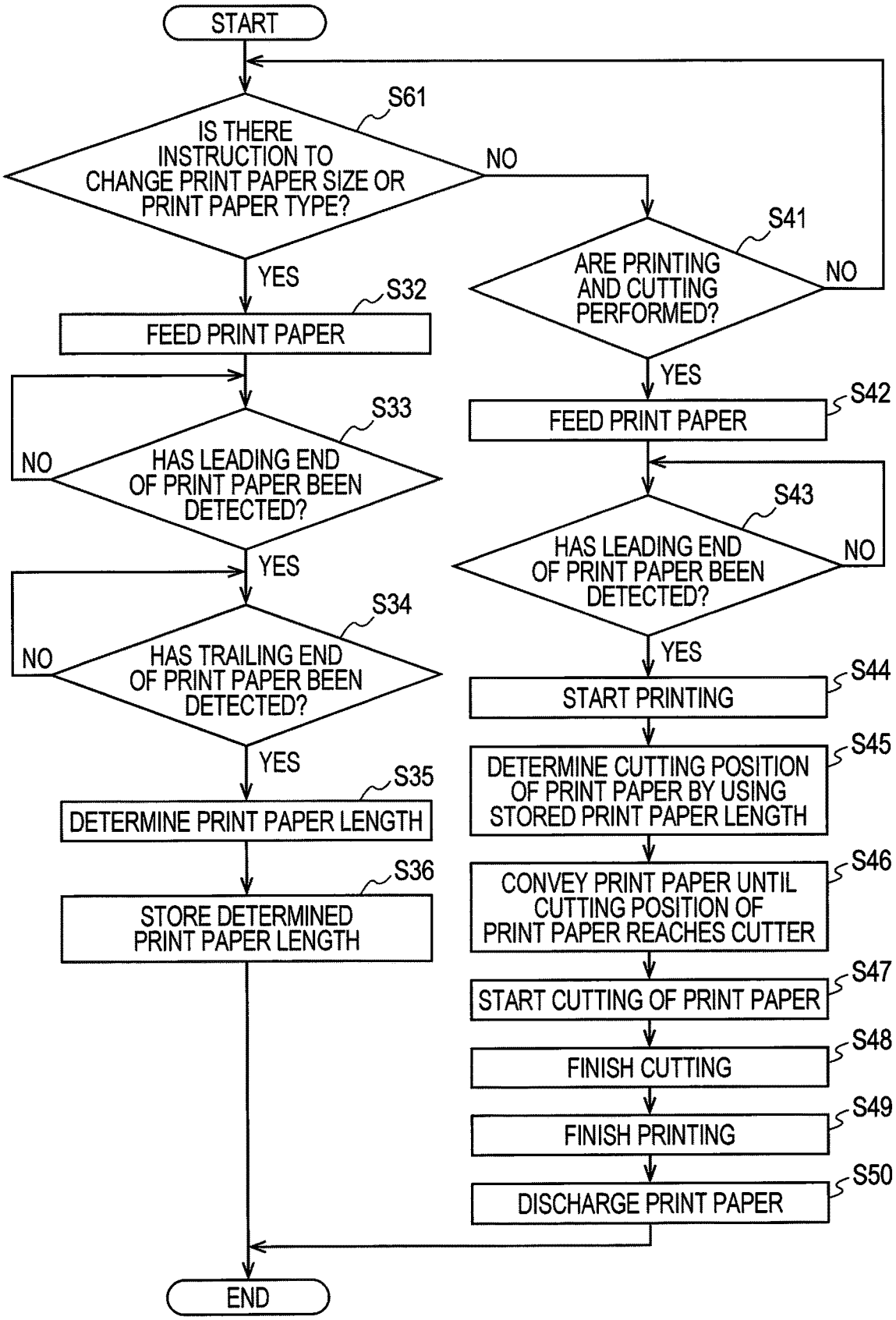
FIG. 6 is a flowchart showing the operation of a printer when a print paper length of print paper is determined and printing and cutting of print paper are performed based on the control of a controller included in the printer according to still another embodiment of this disclosure.

FIG. 6 shows the operation of the printer 3 when the print paper length of print paper 16 is determined and the printing and cutting of the print paper 16 are performed by the control of controller 61.

As shown in FIG. 6, in response to receiving an instruction to change the print paper size or the print paper type through the operation interface 53 (S61: YES), the controller 61 simply conveys (without printing or cutting) the first print paper 16 in the paper feed tray 11 that accommodates the print paper 16 specified by the change instruction, and determines the print medium length (S32 to S35, print-medium-length determination operation). The determined print paper length is stored in the memory 43 (S36).

When determining the cutting position of the second and subsequent print paper 16 fed from the same paper feed tray 11, the controller 61 determines the cutting position based on the print paper length stored in the memory 43 (that is, the print paper length determined by the print-medium-length determination operation) (S41 to S43, S45). Other operations are the same as the operations of the controller 51.

[Advantages of Printer 3]

It is assumed that each of the plurality of paper feed trays 11 for respective ones of a plurality of sizes or a plurality of types accommodates the same lot of print paper 16 and that, within the same lot, the print paper length of each print paper 16 is usually the same. Thus, the printer 3 performs the above operations, thereby reducing the number of operations for determining the print paper length of the print paper 16 and improving the efficiency of the processing performed by the controller 61.

In the printer 3, as in the case of the printer 2, in a case where the print paper 16 conveyed for determining the print paper length is held in the reverse conveyance path 152 without being discharged to the paper discharge tray 13, the print paper 16 is returned from the reverse conveyance path 152 to the main conveyance path 151 and is reused for the next job. Other advantages of the printer 3 are similar to those of the printer 1.

Fourth Embodiment

Still another embodiment of this disclosure is described below. For convenience of description, the same reference numerals are added to the members having the same functions as the members described in the above embodiment, and the description thereof is not repeated.

[Configuration of Printer 4]

Figure 7A:
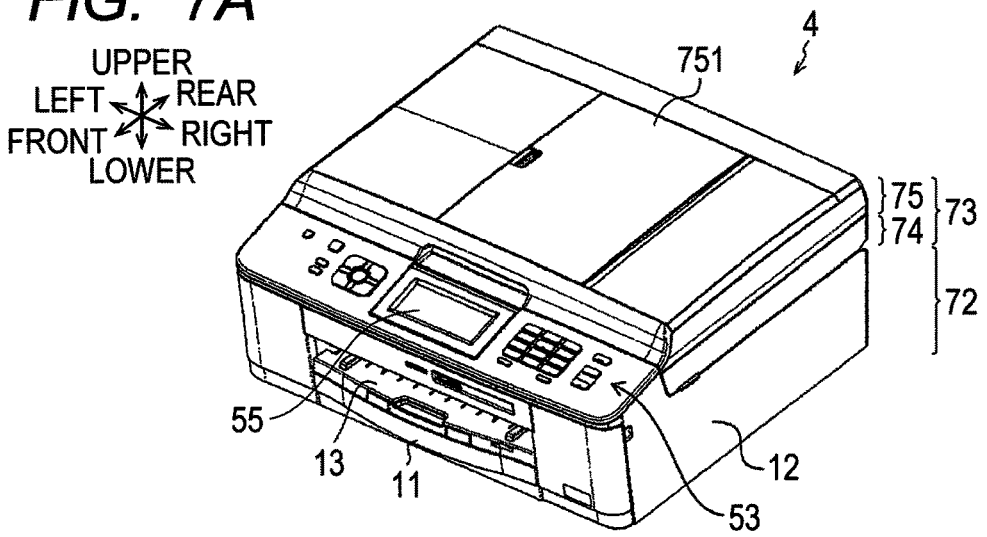
FIG. 7A is a perspective view of a printer according to still another embodiment of this disclosure.
Figure 7B:
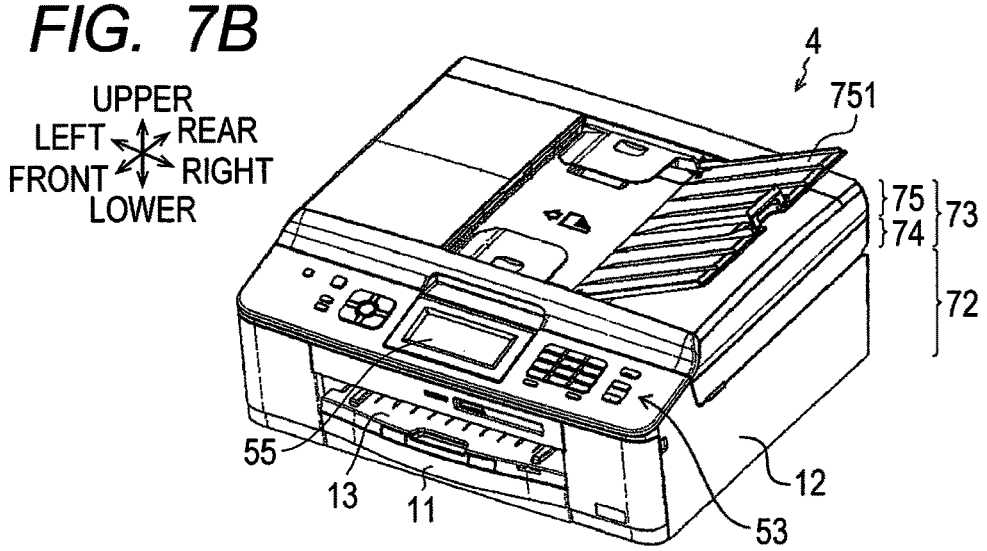
FIG. 7B is a perspective view of the printer in a state where a sub-tray of a scanner unit is opened.

As shown in FIGS. 7A and 7B, a printer 4 of this embodiment has a configuration in which a scanner unit 73 (a reading unit) is provided above a main unit 72 having a printing function. The scanner unit 73 is configured to be rotatably moved in a direction in which the front end side moves up and down with the rear end side as the center of rotation. With this configuration, the scanner unit 73 is movable between a position where the upper opening of the main unit 72 is closed and a position where the upper opening is opened.

The scanner unit 73 has a structure that an ADF (Auto Document Feeder) is incorporated in a cover portion of a flatbed (hereinafter abbreviated as FB) type image scanner. The scanner unit 73 includes an FB main body 74 and an ADF unit 75 that covers the upper surface of the FB main body 74.

The FB main body 74 includes an image sensor 742 that reads an image of a document placed on a document placement surface, which is the upper surface of a glass plate 741. The image sensor 742 is provided under the glass plate 741. The image sensor 742 also reads an image of a document conveyed by the ADF unit 75.

The ADF unit 75 is configured to be rotatably moved in a direction in which the front end side moves up and down with the rear end side as the center of rotation. With this configuration, the ADF unit 75 is configured to be movable between a position covering the upper surface of the glass plate 741 and a position exposing the upper surface of the glass plate 741. A document tray 751 (sub-tray) is provided on the upper surface of the ADF unit 75. The document tray 751 is opened and closed in an obliquely-laterally open state and a closed state. The operation interface 53 described above is provided on the upper surface of the front portion of the main unit 72.

Figure 7C:
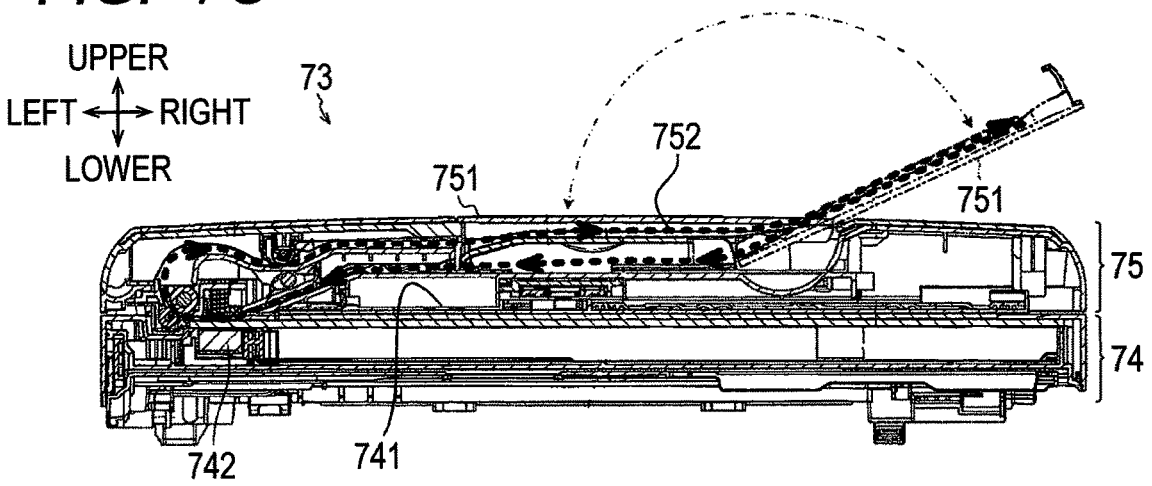
FIG. 7C is a schematic vertical cross-sectional view showing the structure of the scanner unit of the printer.

The ADF unit 75 has a document conveyance path 752 shown by a broken line in FIG. 7C, and conveys a document placed on the document tray 751 through the document conveyance path 752. The FB main body 74 reads an image of a document conveyed along the document conveyance path 752 by using the image sensor 742.

[Configuration of Control Device]

Figure 8:
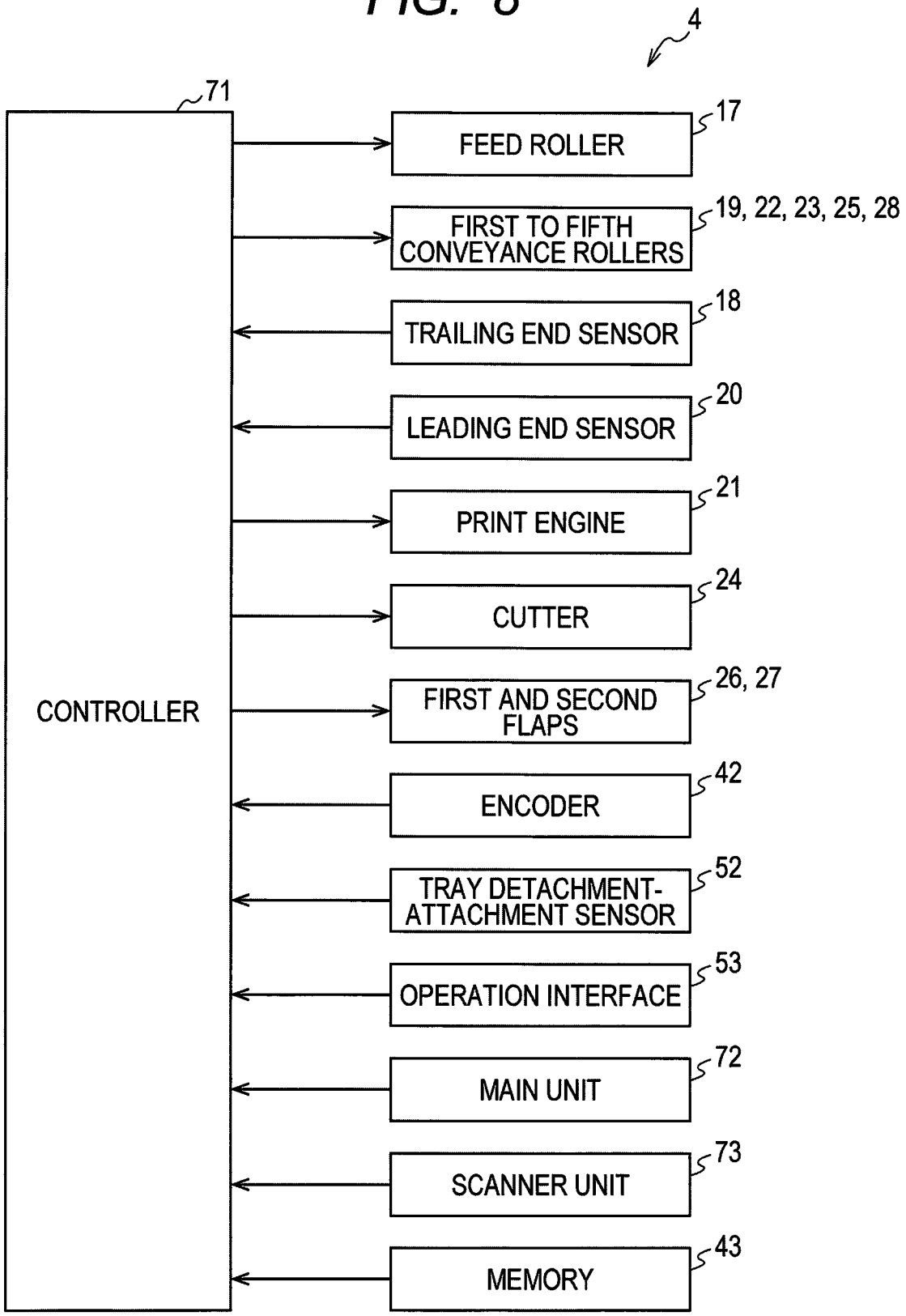
FIG. 8 is a block diagram showing the configuration of a control device included in a printer according to still another embodiment of this disclosure.

As shown in FIG. 8, the control device of the printer 4 includes a controller 71. The controller 71 controls the operation of the printer 4 including the main unit 72 and the scanner unit 73.

[Operation of Printer 4]

Figure 9A:
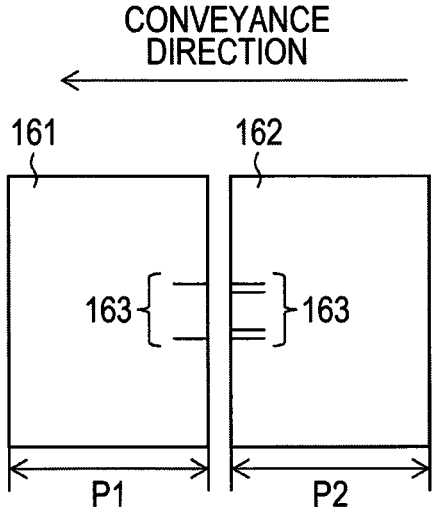
FIG. 9A is an explanatory diagram showing an example in which print paper is cut to be divided into two parts of first paper and second paper by a test cutting operation of the printer shown in FIG. 8.
Figure 9B:
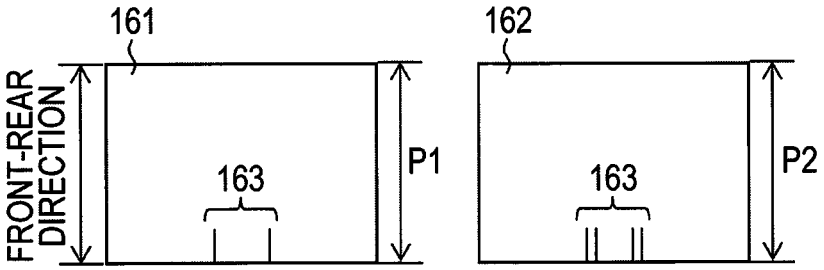
FIG. 9B is an explanatory diagram showing an operation of reading the lengths of first paper and second paper in a conveyance direction by a test reading operation.
Figure 10:
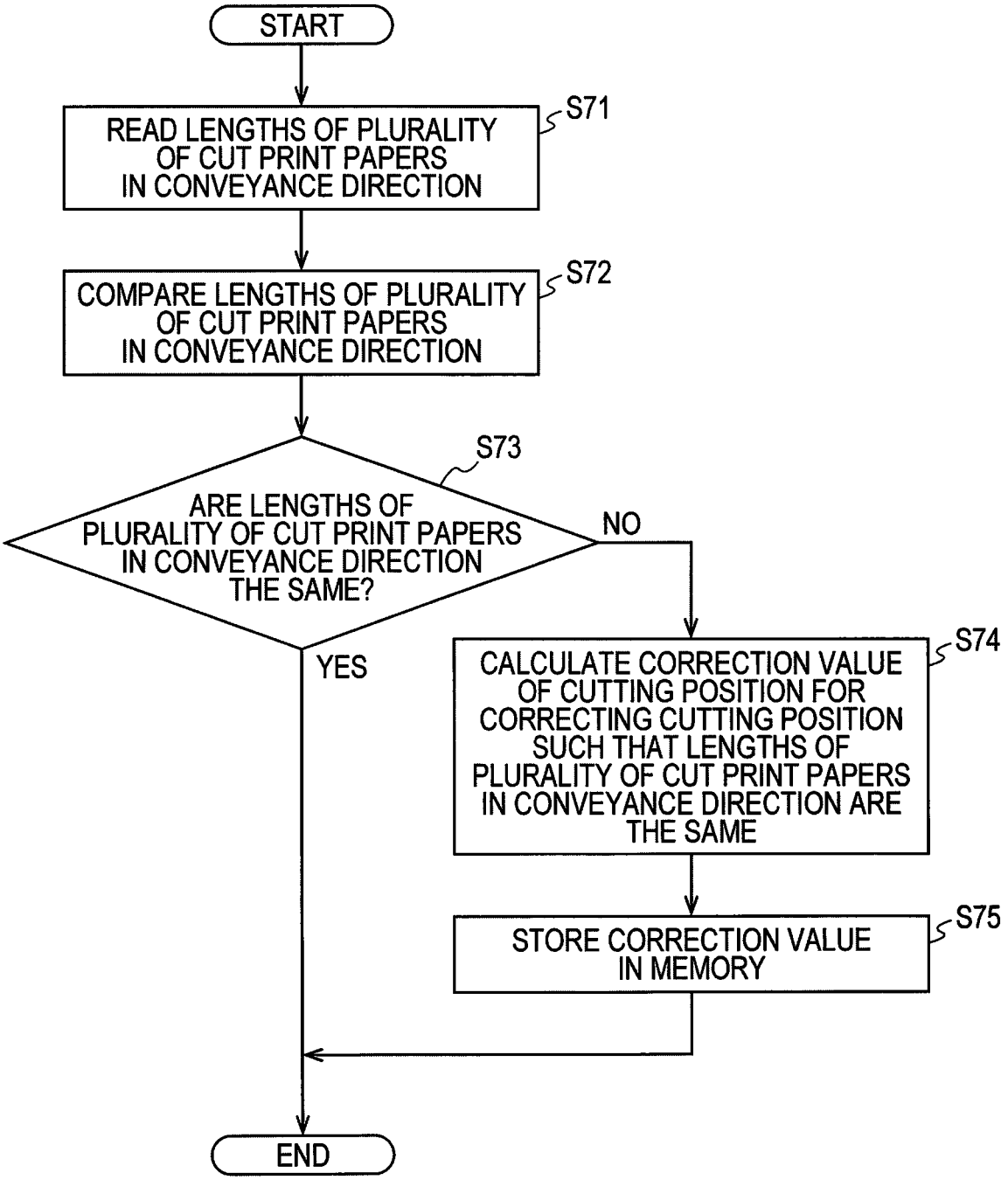
FIG. 10 is a flowchart showing the operation of the test reading operation and a cutting-position correction operation of the printer based on the control of the controller shown in FIG. 8.

As shown in FIGS. 9A, 9B, and 10, the printer 4 performs a test cutting operation, a test reading operation, and a cutting-position correction operation by the control of the controller 71, in addition to the above-mentioned operations performed by the printers 1 to 3.

[Test Cutting Operation]

In the test cutting operation, the print paper 16 as an example of a blank print medium in the paper feed tray 11 is cut to an equal length by the cutting operation for a test purpose. In this case, the printer 4 performs the operations S11 to S21 shown in FIG. 4 by the control of the controller 71. However, since printing is not performed here, the operations of S13 and S20 are not performed.

[Test Reading Operation]

In the test reading operation, as shown in FIGS. 9A and 9B, the printer 4 reads the actual lengths, in the conveyance direction, of the plurality of cut print papers obtained by cutting the print paper 16 by the test cutting operation by using the scanner unit 73 (S71). When the print paper 16 is cut into two parts of cut print paper 161 and cut print paper 162 by the test cutting operation (FIG. 9A), it is preferable that a conveyance-direction length P1 of the cut print paper 161 and a conveyance-direction length P2 of the cut print paper 162 be read such that the lengths P1, P2 are aligned with the longitudinal direction of the image sensor 742 (the front-rear direction). In other words, it is preferable that the cut print papers 161 and 162 be read by the image sensor 742 in a state where the sides corresponding to the lengths P1 and P2 are oriented in the front-rear direction. In this case, the controller 71 acquires the length of the read cut print paper in the front-rear direction as the length of the cut print paper in the conveyance direction. For that purpose, a display for instructing the orientation when the cut print paper is set in the document tray 751 may be displayed on a display 55 (FIGS. 7A and 7B) provided on the front face of the apparatus, for example. In this way, by reading the conveyance-direction lengths P1 and P2 aligned in the longitudinal direction of the image sensor 742, the conveyance-direction lengths of the print papers 161 and 162 after cutting can be accurately read.

[Cutting-Position Correction Operation]

In the cutting-position correction operation, as shown in FIG. 10, the controller 71 compares the lengths of the plurality of cut print papers in the conveyance direction that are obtained in the test reading operation (for example, the conveyance-direction lengths P1 and P2) (S72). As a result of the comparison in S72, if the lengths of the plurality of print papers in the conveyance direction are the same (for example, the length P1 is equal to the length P2) (S73), the processing ends.

As a result of the comparison in S72, if the lengths of the plurality of cut print papers in the conveyance direction are not the same (for example, the length P1 is not equal to P2) (S73), the controller 71 obtains (calculates) a correction value of the cutting position for correcting the cutting position such that the lengths of the plurality of cut print papers in the conveyance direction are the same (S74). The controller 71 stores the obtained correction value in the memory 43 (S75). After this processing, the controller 71 determines the cutting position of the print paper 16 in consideration of the obtained correction value.

For example, if the conveyance-direction length P1 of the print paper at the downstream side is longer by 2 mm (millimeters) than the conveyance-direction length P2 of the print paper at the upstream side, the cutting position is shifted to the downstream side by 1 mm. Specifically, the controller 71 corrects (changes) the conveyance amount of the print paper for correcting the cutting position.

With this processing, in the printer 4, even if there is a deviation between the calculated cutting position and the actual cutting position due to a deviation in the mount position of the cutting blade of the cutter 24 or deterioration of the conveyance rollers, the print paper 16 can be cut accurately at a desired position. Note that the test cutting operation, the test reading operation, and the cutting-position correction operation may be performed before the printer 4 is shipped as a product.

[Marking Operation]

By the control of the controller 71, the printer 4 may use the print engine 21 to print, on the print paper 16, a marking for distinguishing between the cut print paper at the upstream side and the cut print paper at the downstream side. For example, as shown in FIGS. 9A and 9B, the print engine 21 prints markings 163 on the cut-side end of the cut print papers 161, 162. The markings 163 have different shapes between the cut print paper at the upstream side and the cut print paper at the downstream side.

In this case, after determining the cutting position of the print paper 16, the controller 71 controls the conveyance unit 15 and the print engine 21 to convey the print paper 16 in the reverse direction and to print the markings 163 at the cutting position of the print paper 16. After that, the controller 71 controls the conveyance unit 15 to convey the print paper 16 in the forward direction and controls the cutter 24 to cut the print paper 16. Alternatively, the controller 71 may control the conveyance unit 15, the cutter 24, and the print engine 21 to cut the print paper 16 into a plurality of cut print papers, and then convey the cut print papers in the reverse direction and print the markings 163.

By printing the markings 163 on the cut print paper as described above, the controller 71 determines whether the read image of each cut print paper is an image of the cut print paper at the upstream side or an image of the cut print paper at the downstream side.

In each of the above-described embodiments, the printers 1 to 4 are configured to cut the print paper 16 in half (½), but the present disclosure is not limited to this. For example, the print paper 16 may be cut into smaller sizes for printing on strips of paper. Alternatively, the cutting position may be determined to obtain paper that is larger than half the size of the print paper 16. In either case, according to this disclosure, the print paper 16 is cut after actually obtaining the print paper length which is the length of the print paper 16 in the conveyance direction. Thus, the print paper 16 can be cut with high accuracy for obtaining paper of a desired size.

[Implementation by Software]

The control blocks of the printers 1 to 4 (particularly, the controllers 41, 51, 61, and 71) may be realized by a logic circuit (hardware) formed in an integrated circuit (IC chip) and so on, or may be realized by software.

In the latter case, the printers 1 to 4 include a computer that executes a program instruction, which is software that realizes each function. The computer includes, for example, one or more processors and a computer-readable recording medium that stores the program. In the computer, the processor reads the program from the recording medium and executes the same, thereby achieving the purpose of this disclosure. As the processor, for example, a CPU (Central Processing Unit) may be used. As the recording medium, a non-transitory tangible medium, for example, a ROM (Read Only Memory) and so on, a tape, a disk, a card, a semiconductor memory, a programmable logic circuit, and so on may be used. A RAM (Random Access Memory) for expanding the above program may be further provided. The program may be supplied to the computer through an arbitrary transmission medium (communication network, broadcast wave, and so on) capable of transmitting the program. One aspect of this disclosure may also be realized in the form of a data signal embedded in a carrier wave in which the above program is embodied by electronic transmission.

In the printing apparatus according to one aspect of this disclosure, a relationship L>A−a may be satisfied when "L" is a distance between the first sensor and the cutter in the conveyance direction, "A" is a print medium length of a particular print medium that is one of a plurality of standard sizes of print mediums, and "a" is a length from a leading end of the particular print medium to a cutting position.

According to above-described configuration, the controller detects the print medium length before the print medium having the print medium length shorter than or equal to the print medium length of the particular print medium reaches the cutter, and determines the cutting position. Thus, with respect to the print medium having the print medium length shorter than or equal to the print medium length of the particular print medium, the print medium can be cut without loss of time.

In the printing apparatus according to one aspect of this disclosure, the controller may be configured to: perform printing on the print medium by alternately repeating a line feed operation of conveying the print medium by a line feed amount determined based on acquired print data, and a recording operation of controlling the print engine to record an image of one line in a state where conveyance of the print medium is stopped; identify, from among a plurality of line feed operations, a line feed operation in which the cutting position of the print medium passes the cutter; and control the conveyor to perform the line feed operation with a smaller conveyance amount than the determined line feed amount in the identified line feed operation.

According to above-described configuration, in the configuration of alternately repeating the conveyance operation of the print medium by conveyor and the recording operation on the print medium by the print engine, the print medium can be conveyed accurately to the cutter, specifically, the cut position of the cutter.

In the printing apparatus according to one aspect of this disclosure, the cutter may be disposed downstream of the print engine in the conveyance direction.

According to above-described configuration, the cutting operation of the print medium by the cutter and the print operation by the print engine can be performed concurrently. Thus, the processing can be performed at high speed.

In the printing apparatus according to one aspect of this disclosure, at least one pair of rollers configured to nip and convey a print medium may be provided between the cutter and the print engine.

According to above-described configuration, because the at least one pair of rollers nips the print medium, printing by the print engine can be performed in a stable manner.

In the printing apparatus according to one aspect of this disclosure, at least one pair of rollers configured to nip and convey a print medium may be provided downstream of the cutter in the conveyance direction.

According to above-described configuration, because the at least one pair of rollers nips the print medium, the deviation of the print medium at the cutter and the print deviation at the print engine can be suppressed.

The printing apparatus according to one aspect of this disclosure may further include a third sensor configured to detect detachment and attachment of the tray. The controller may be configured to, in response to detection of detachment and attachment of the tray by the third sensor: perform a print-medium-length determination operation of conveying, without printing or cutting, a first sheet of the print medium in the tray and determining the print medium length; and determine a cutting position to be cut by the cutter for second and subsequent sheets of the print medium in the tray, based on the print medium length determined by the print-medium-length determination operation.

According to above-described configuration, because the print-medium-length determination operation is performed for print mediums in each lot accommodated in the tray, the number of times of the print-medium-length determination operation can be reduced.

The printing apparatus according to one aspect of this disclosure may further include an operation interface configured to receive an input operation by a user. The tray may include a plurality of trays provided for respective ones of a plurality of print medium sizes or a plurality of print medium types. The controller may be configured to, in response to receiving input of a change instruction of a print medium size or a print medium type through the operation interface: perform a print-medium-length determination operation of conveying, without printing or cutting, a first sheet of the print medium in the tray accommodating the print medium specified by the change instruction and determining the print medium length; and determine a cutting position to be cut by the cutter for second and subsequent sheets of the print medium in the tray, based on the print medium length determined by the print-medium-length determination operation.

According to above-described configuration, because the print-medium-length determination operation is performed for print mediums in each tray, the number of times of the print-medium-length determination operation can be reduced.

In the printing apparatus according to one aspect of this disclosure, the conveyor may include a main conveyance path and a reverse conveyance path. The main conveyance path is a conveyance path of a print medium from the tray to the cutter. The reverse conveyance path is a conveyance path for reversing a print medium conveyed through the main conveyance path and returning the print medium to the main conveyance path. The controller may be configured to control the conveyor to hold the print medium used for the print-medium-length determination operation in the reverse conveyance path and to return the print medium in the reverse conveyance path to the main conveyance path so as to use the print medium at a next operation.

According to above-described configuration, the print medium used for the print-medium-length determination operation is not discharged but can be reused for the next print job.

The printing apparatus according to one aspect of this disclosure may further include a scanner (reader) configured to read an image of a document. The controller may be configured to control the scanner, the conveyor, and the cutter to perform: a test cutting operation of cutting a blank print medium in the tray into equal lengths to obtain a plurality of print mediums; a test reading operation of using the scanner to read lengths of the plurality of print mediums in a conveyance direction; and a correction operation of comparing the lengths of the plurality of print mediums in the conveyance direction and correcting a cutting position to be cut by the cutter.

According to above-described configuration, because the cutting-position correction operation of the print medium is performed, the print medium can be cut accurately at the desired position.

In the printing apparatus according to one aspect of this disclosure, the controller may be configured to control the print engine to perform a marking operation of printing a marking on the blank print medium, the marking being for distinguishing upstream and downstream positions of the plurality of print mediums in the conveyance direction, the plurality of print mediums being obtained by the test cutting operation.

According to above-described configuration, the upstream and downstream positions of the blank print medium obtained by the test cutting operation can be identified easily due to the marking.

While the disclosure has been described in detail with reference to the above aspects thereof, it would be apparent to those skilled in the art that various changes and modifications may be made therein without departing from the scope of the claims. Embodiments obtained by appropriately combining the technical features disclosed in different embodiments are also included in the scope of this disclosure.

What is claimed is:

1. A printing apparatus comprising:

a tray configured to accommodate a print medium;

a conveyor configured to feed the print medium from the tray and to convey the print medium along a conveyance direction;

a print engine configured to perform printing on the print medium conveyed by the conveyor;

a cutter configured to cut the print medium conveyed by the conveyor;

a first sensor provided upstream of the cutter in the conveyance direction and configured to detect a leading end and a trailing end of the print medium;

a second sensor configured to detect a conveyance amount of the print medium conveyed by the conveyor; and a controller configured to:

determine a print medium length that is a length of the print medium in the conveyance direction, based on the conveyance amount detected by the second sensor from when the first sensor detects the leading end of the print medium until when the first sensor detects the trailing end of the print medium;

determine a cutting position of the print medium based on the determined print medium length; and control the cutter to cut the print medium at the determined cutting positon.

2. The printing apparatus according to claim 1, wherein a relationship L>A−a is satisfied when "L" is a distance between the first sensor and the cutter in the conveyance direction, "A" is a print medium length of a particular print medium that is one of a plurality of standard sizes of print mediums, and "a" is a length from a leading end of the particular print medium to the cutting position.

3. The printing apparatus according to claim 1, wherein the controller is configured to:

perform printing on the print medium by alternately repeating a line feed operation of conveying the print medium by a line feed amount determined based on acquired print data, and a recording operation of controlling the print engine to record an image of one line in a state where conveyance of the print medium is stopped;

identify, from among a plurality of line feed operations, a line feed operation in which the cutting position of the print medium passes the cutter; and control the conveyor to, in the identified line feed operation, perform a line feed operation with a smaller conveyance amount than the determined line feed amount.

4. The printing apparatus according to claim 2, wherein the cutter is disposed downstream of the print engine in the conveyance direction.

5. The printing apparatus according to claim 3, wherein at least one pair of rollers configured to nip and convey a print medium is provided between the print engine and the cutter.

6. The printing apparatus according to claim 5, wherein at least one pair of rollers configured to nip and convey a print medium is provided downstream of the cutter in the conveyance direction.

7. The printing apparatus according to claim 1, further comprising a third sensor configured to detect detachment and attachment of the tray, wherein the controller is configured to, in response to detection of detachment and attachment of the tray by the third sensor, perform a print-medium-length determination operation of conveying a first sheet of the print medium in the tray and determining the print medium length; and determine the cutting position for second and subsequent sheets of the print medium in the tray, based on the print medium length determined by the print-medium-length determination operation.

8. The printing apparatus according to claim 1, further comprising an operation interface configured to receive an input operation by a user, wherein the tray includes a plurality of trays provided for respective ones of a plurality of print medium sizes or a plurality of print medium types; and wherein the controller is configured to, in response to receiving input of a change instruction of a print medium size or a print medium type through the operation interface, perform a print-medium-length determination operation of conveying a first sheet of the print medium in the tray accommodating the print medium specified by the change instruction and determining the print medium length; and determine the cutting position for second and subsequent sheets of the print medium in the tray, based on the print medium length determined by the print-medium-length determination operation.

9. The printing apparatus according to claim 7, wherein the conveyor includes a main conveyance path and a reverse conveyance path, the main conveyance path being a conveyance path of a print medium from the tray to the cutter, the reverse conveyance path being a conveyance path for reversing a print medium conveyed through the main conveyance path and returning the print medium to the main conveyance path; and wherein the controller is configured to control the conveyor to hold the print medium used for the print-medium-length determination operation in the reverse conveyance path and to return the print medium in the reverse conveyance path to the main conveyance path so as to use the print medium at a next operation.

10. The printing apparatus according to claim 1, further comprising a scanner configured to read an image of a document, wherein the controller is configured to control the scanner, the conveyor, and the cutter to perform:

a test cutting operation of cutting a blank print medium into equal lengths to obtain a plurality of print mediums;

a test reading operation of using the scanner to read lengths of the plurality of print mediums in the conveyance direction; and a correction operation of comparing the lengths of the plurality of print mediums in the conveyance direction and correcting the cutting position.

11. The printing apparatus according to claim 10, wherein the controller is configured to control the print engine to print a marking on the blank print medium, the marking being for distinguishing upstream and downstream positions of the plurality of print mediums in the conveyance direction, the plurality of print mediums being obtained by the test cutting operation.

12. The printing apparatus according to claim 1, wherein the controller is configured to:

detect the leading end of the print medium by the first sensor;

control the print engine to start printing on the print medium;

detect the trailing end of the print medium by the first sensor;

determine the print medium length based on the conveyance amount detected by the second sensor;

determine the cutting position of the print medium based on the determined print medium length;

control the conveyor to convey the print medium forward in the conveyance direction until the cutting position reaches the cutter, without conveying the print medium reversely in the conveyance direction; and control the cutter to cut the print medium at the cutting position.

13. The printing apparatus according to claim 1, wherein the conveyor includes a conveyance roller; and wherein the second sensor includes an encoder provided at a rotation shaft of the conveyance roller.

* * * * *